US005391034A

United States Patent [19]

Di Giusto et al.

[11] Patent Number: 5,391,034

[45] Date of Patent: Feb. 21, 1995

[54] FURNACE WITH REFRACTORY LONGITUDIANL MEMBERS AND WITH CENTRAL CHARGING FOR HEATING AND STORING HOT PRODUCTS

[75] Inventors: Bruno Di Giusto, Udine; Giampietro Benedetti, Campoformido, both of Italy

[73] Assignee: Danieli & C. Officine Meccaniche SpA, Buttrio, Italy

[21] Appl. No.: 884,177

[22] Filed: May 18, 1992

[30] Foreign Application Priority Data

May 21, 1991 [IT] Italy ..... UD91 A 000085

[51] Int. Cl.[6] ..... C21D 1/00; F27B 9/24

[52] U.S. Cl. ..... 414/156; 198/457; 198/774.1; 414/198; 432/123; 432/144

[58] Field of Search ..... 414/152, 156, 160, 173, 414/198, 209; 432/122, 123, 128, 137, 144; 198/457, 774.1

[56] References Cited

U.S. PATENT DOCUMENTS

| | | | |
|---|---|---|---|
| 3,148,868 | 9/1964 | Sidwell | 432/128 X |
| 3,716,222 | 2/1973 | Anderson | 432/137 X |
| 3,749,550 | 7/1973 | Suydam | 432/122 |
| 3,948,494 | 4/1976 | Werych | 432/122 X |
| 4,025,298 | 5/1977 | Tokitsu | 432/122 |
| 4,289,944 | 9/1981 | Reese | 414/152 X |
| 4,556,385 | 12/1985 | Denis | 432/122 |
| 4,601,743 | 7/1986 | Canfield | 432/122 X |

FOREIGN PATENT DOCUMENTS

| | | | |
|---|---|---|---|
| 2001065 | 7/1971 | Germany | 432/122 |
| 2159109 | 5/1972 | Germany | 432/122 |
| 2346826 | 3/1975 | Germany | 432/122 |
| 58-104113 | 6/1983 | Japan . | |
| 58-104114 | 6/1983 | Japan . | |
| 58-171523 | 10/1983 | Japan . | |
| 61-018541 | 1/1986 | Japan . | |

*Primary Examiner*—David A. Bucci

*Attorney, Agent, or Firm*—Antonelli, Terry, Stout & Kraus

[57] ABSTRACT

Furnace with refractory longitudinal members and with central charging for heating and storing hot products, whereby the central charge arrives from a continuous casting plant or from previous hot processes, the furnace (10) comprising a first furnace portion (10*a*) for the introduction of a cold charge (12) and for storage and also a second furnace portion (10*b*) for discharge of the heated charge (15), the first (10*a*) and second (10*b*) furnace portions comprising stationary longitudinal members (23) and movable longitudinal members (24), the central charging taking place between the first (10*a*) and second (10*b*) furnace portions, a central intake and guide channel (22) being defined as a furnace bed by the plurality of stationary longitudinal members (23) cooperating with the respective plurality of movable longitudinal members (24*a*–24*b*) of the first (10*a*) and second (10*b*) furnace portions, the movable longitudinal members (24*a*–24*b*) in their raised position substantially facing each other, the width of the central intake and guide channel (22) and possibly the height of the movable longitudinal members (24) depending on the cross section of the hot product (26) being charged.

8 Claims, 2 Drawing Sheets

FURNACE WITH REFRACTORY LONGITUDIANL MEMBERS AND WITH CENTRAL CHARGING FOR HEATING AND STORING HOT PRODUCTS

BACKGROUND OF THE INVENTION

This invention concerns a furnace with refractory longitudinal members and with central charging for heating and storing hot products.

The heating furnace with central charging and storage of hot products according to this invention is applied to plants for heating semi-finished products of a great length (even greater than 10–12 meters) and a modest section which does not permit charging with external conveyor equipment.

The heating furnace according to this invention is applied also to plants of which the rate of charging of products is equal to or less than about eighty pieces per hour.

The heating furnace according to the invention arranges that the hot charge fed centrally comes from a continuous casting plant or from previous hot processes.

Various types of furnace with central charging have been disclosed in the state of the art.

A type of plant with central charging has been disclosed with cooled beams and with a lower heating chamber.

Owing to the existence of a free lower chamber the introduction into the furnace is carried out on idler rollers, which are not cooled and consist of heat-resistant materials and are upheld on cooled supports passing through the lower hearth of the furnace.

By means of this embodiment the process is shortened, as also is the stay time of the hot products in the furnace, but this does not overcome the problem of storage. Another embodiment consists of a furnace with central introduction of the charge ant with refractory longitudinal members.

In this case too only the aim of shortening the stay time of the hot products in the furnace is fulfilled, while the technological solution disclosed requires the use of a gripping machine to introduce the products without contact with the hearth.

The limitations of this embodiment consist of the short length of the products which can be charged, the high cost of the machine, the higher consumption of energy, the lower mechanical reliability and, lastly, the lack of a solution to collect the scale at the position of introduction of hot products.

SUMMARY OF THE INVENTION

The present applicants have designed, tested and embodied the following invention to overcome the problems of the state of the art and to achieve further advantages.

The furnace with refractory longitudinal members and with central charging for heating and storing hot products according to this invention is applied to plants of which the rate of treatment of products is equal to or less than about eighty pieces per hour.

The purpose of this invention is to employ one single heating furnace for hot charges consisting of products coming from a continuous casting plant or from other previous hot processes (cogging train) and for the storage of hot products within the furnace and, lastly, for heating products from the cold state with an output equivalent to that which can be achieved with hot charges.

The heating furnace according to the invention provides the following advantages:

- smaller investment than that required for the installation of multiple furnaces differentiated for specific use with cold or hot charges and for storage of the same;
- less space to be equipped (sheds) and less mechanisms to handle the products;
- greater thermal yield of the assembly and overall energy consumption reduced to the minimum values which can now be achieved with heating units of the latest generation;
- shorter stay time in the furnace for hot charges since the hot charge is introduced at an intermediate point in the furnace; this fact reduces oxidation and decarburization of the product besides reducing energy consumption;
- the employment of a part of the furnace, which tends to be kept empty during working with a hot charge, to store hot products coming from continuous casting, for instance in the event of a stoppage of the train or for other requirements;
- the storage zone of the furnace is heated by means of sensible heat contained in the fumes arriving from the heating and discharge zones of the furnace;
- the use of a length of the furnace in proportion to the minimum heating time needed according to the characteristics of the hot charge;
- the ability to employ the upstream portion of the furnace for the pre-heating of cold products at the same time as the use of the downstream port ion of the furnace for a hot charge during the period of passing from a working programme with a hot charge to a working programme with a cold charge; this change from one working programme to another takes place without interrupting the production process, thus using the working time fully without non-productive waiting periods besides optimizing the energy consumption;
- introduction of the cold charge at the upstream end of the furnace in two directions normal to the direction of feed of the material within the furnace;
- discharge of the heated product from the downstream end of the furnace in two directions normal to the direction of feed of the material within the furnace;
- intake of the hot charge, for instance coming directly from the continuous casting plant, at the central part of the furnace in a direction normal to the direction of feed of the material within the furnace;
- the ability to send the hot charge introduced at the central part of the furnace either into the final heating portion in one direction or into the storage portion in the other direction according to requirements and without any need for special prearrangement dispositions;
- smaller labour force and greater reliability with resulting reductions in maintenance times and costs.

In the heating furnace with central charging for heating and storing hot products according to this invention the hot products are fed into the furnace through a central intake channel consisting of movable guides which can be adapted to the dimensions of the product being fed. The reason for this is that the handling process is reliable, and the purpose is to avoid causing excessive wear of parts of the furnace such as the hearth and the longitudinal members.

It is necessary to bear in mind that the products may contain strains such as bends, buckling of the ends, etc. which lead to a movement which is not perfectly straight.

For this reason the profile of the central intake channel in the heating and storage furnace with central introduction of hot products according to the invention is determined in such a way as always to bring the leading end of the product into the containing profile.

During introduction into the heating furnace according to the invention the product is placed in the required position owing to the inclusion of a mechanism called "the final abutment element", which is adjusted advantageously from the outside.

The product, after having been wholly introduced, is realigned transversely by using a portion of the longitudinal members as a movable side of the guide channel, thus reducing the width of the channel to a desired value in proportion to the section of the product.

The product introduced is now engaged in a known manner by the movable longitudinal members and is conveyed towards the discharge from the furnace or towards the storage section of the furnace, as required.

The heating and storage furnace with central charging according to the invention overcomes the problems linked to the mechanical strength of the internal components of the furnace as regards impacts of the leading end of the product under high temperature conditions and the resistance of the product to wear by sliding.

The sliding action which takes place during charging assists removal of the already limited layer of oxidation on the outer surface of the product.

This scale should not build up in the hearth, and therefore the furnace according to the invention comprises a system for discharge of the scale into collection hoppers positioned in correspondence with the movable longitudinal members and between two containing channels located below the movable longitudinal members.

The furnace according to the invention consists substantially of two furnace portions, of which the movable longitudinal members conveying the products are equipped with actuation systems which are independent but reciprocally conditioned and capable of being synchronized when charging has to be carried out.

These two furnace portions are positioned one after the other and alongside each other so that, when so required, they can become one single furnace, for instance in the case of a cold charge which has to pass through the various environments of the furnace, namely pre-heating, heating and temperature equalization.

Optimum usage of energy by the heating furnace with central charging according to the invention is achieved by using the heating energy contained in the fumes coming from the heating and discharge zone of the furnace so as to heat the pre-heating and storage zone of the furnace.

This method obviates also a great loss of energy through the discharge of high temperature fumes as well as thermal pollution of the environment without employing expensive, complex systems to recover the sensible heat of the fumes.

The operation of the type of furnace according to the invention makes necessary control systems which include:

a) a system for the mechanical automation of the control of the double, reciprocally conditioned movement of the longitudinal members and of the control of the position of each product in the furnace, whatever the path carried out by that product may be, such as
   - hot charging followed by final heating and discharge;
   - hot charging and storage;
   - removal from storage followed by final heating and discharge;
   - cold charging, complete heating and discharge.

The automation system according to the invention provides the machine operator with a map of the products in the furnace, the map being continually updated and displayed on a video display unit and/or on a printer, advantageously accompanied by a graphical representation of the process.

b) A thermal automation system to control the various pre-calculated and stored heating curves, which can be called upon for the setting of the zone temperature upon variation of the working conditions.

According to a variant the automation system is redundant and comprises two supervision and communication systems consisting, for instance, of two personal computers in communication with each other, one of them having the purpose of supervising the mechanical automation, whereas the other supervises the thermal automation.

Moreover, in the furnace according to the invention the two supervision and communication systems are able also to take over each other's functions and thus to ensure the automatic working of the plant even in the event of a breakdown or malfunction of either of the two supervision systems.

BRIEF DESCRIPTION OF THE DRAWINGS

The attached figures are given as a non-restrictive example and show a preferred embodiment of the invention as follows.

DETAILED DESCRIPTION OF THE PREFERRED EMBODIMENTS

Figure 1:
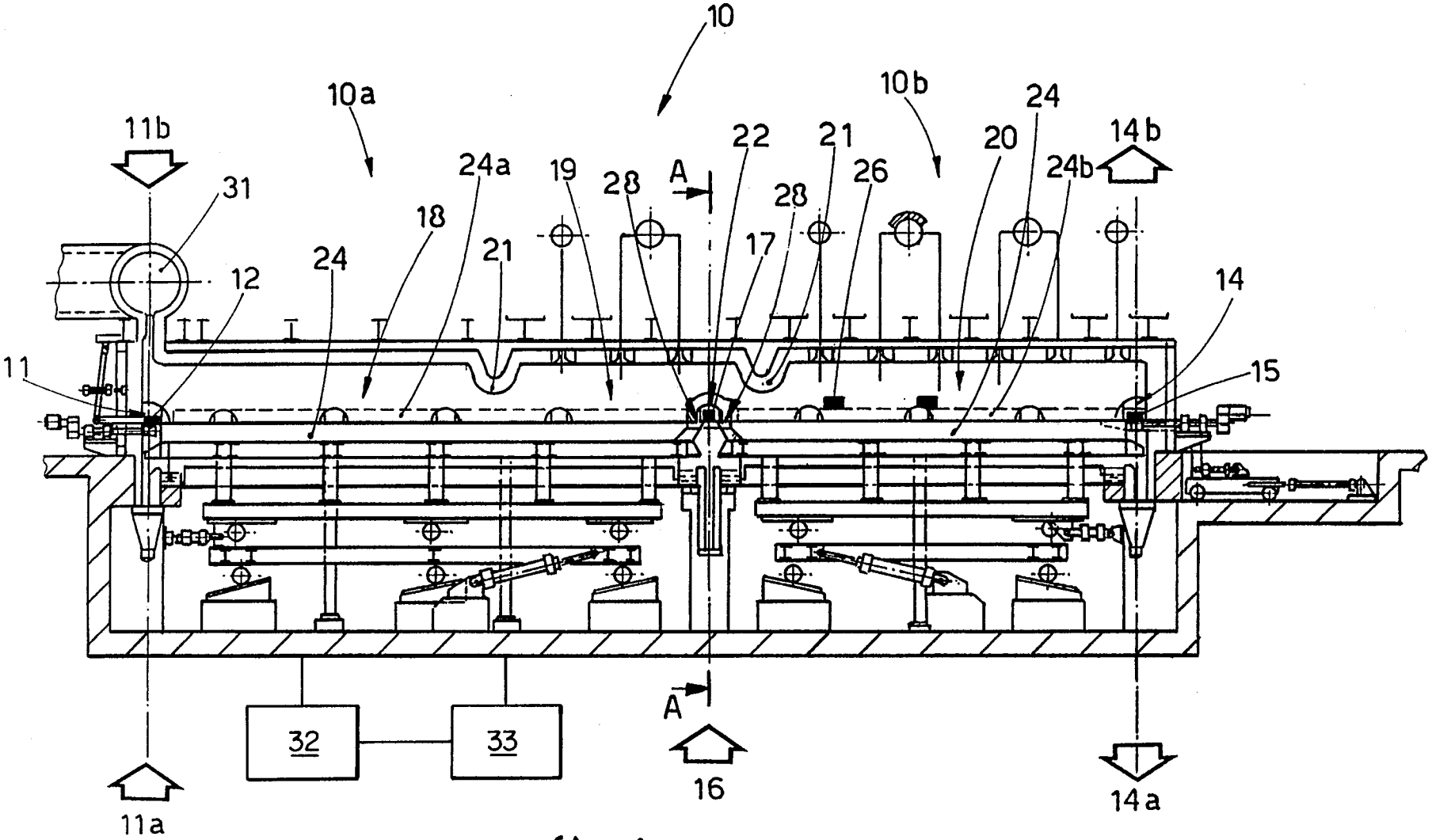
FIG. 1 shows a vertical cross section of a furnace according to the invention.
Figure 2:
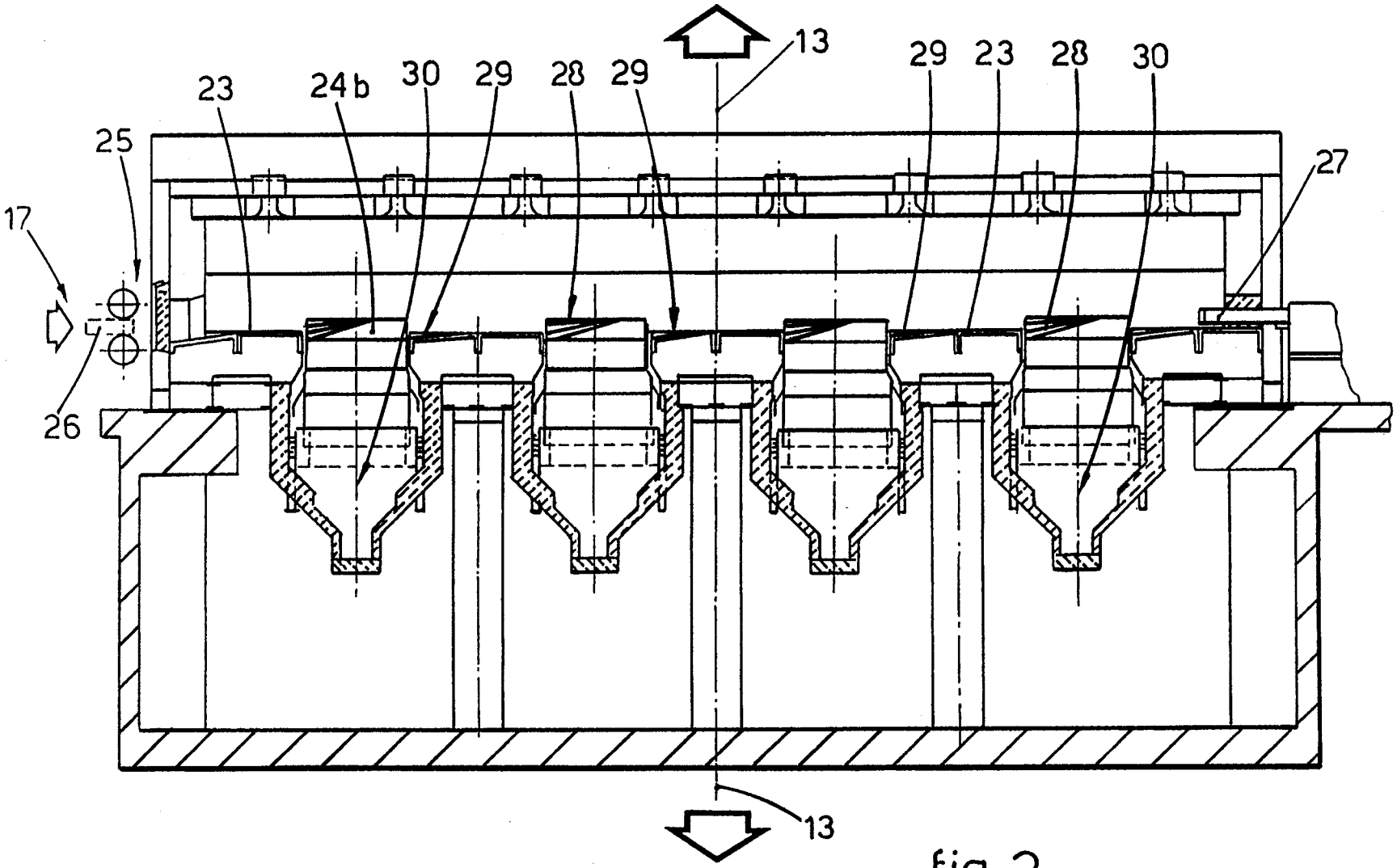
FIG. 2 shows a lengthwise section of the furnace along the line A—A of FIG. 1

In the figures the reference number 10 indicates generally a heating furnace according to the invention.

The heating furnace 10 according to the invention consists substantially of two distinct furnace elements, a first 10*a* and a second 10*b*, one following the other, which may become one single furnace 10, if so required, in the event of heating products in the cold state, for instance.

The heating furnace 10 according to the invention possesses the following features:

an intake 11 for a cold charge 12, which is positioned at the upstream end of the heating furnace 10 and through which the cold material 12 can be charged in two directions, 11*a* and 11*b* respectively, in a direction normal to the lengthwise axis 13 of the furnace 10; namely from one side 11*a* and from the other side 11*b*;

a central intake 16 for a hot charge 17, which is positioned at the centre of the heating furnace 10 at the point of joining of the two furnace elements 10*a*–10*b*; through this central intake 16 the hot material 17 consisting, for instance, of a product 26 coming from a continuous casting plant can be charged in a direction normal to the lengthwise axis 13 of the furnace 10;

an outlet 14 for the heated material 15, which is positioned at the downstream end of the heating furnace 10; through this outlet 14 the heated material 15 can be discharged in two directions, 14*a*–14*b* respectively, in a direction orthogonal to the lengthwise axis 13 of the furnace 10, that is, from both sides 14*a* and 14*b*.

Moreover, the heating furnace 10 according to the invention comprises a first heat regeneration zone 18 positioned in the upstream end of the furnace 10 in the direction of feed, a second central pre-heating zone 19 positioned immediately upstream of the central charging intake 16 and a third final heating and temperature equalization zone 20 positioned downstream of the central intake 16.

The two zones 18-19 together form a portion of the furnace 10 which tends to be kept empty for the storage of hot products in the event of a stoppage of the rolling mill.

The three zones 18-19-20 are delimited in this case by two lower segments of the crown 21 of the furnace 10, which form thermal shields and enable the temperature to be differentiated in the various zones according to the different requirements of the processes selected.

During a process entailing the charging of hot products the heating of the storage portion consisting of the heat regeneration zone 18 and pre-heating zone 19 of the furnace 10 takes place by means of sensible heat contained in the fumes coming from the heating and temperature equalization zone 20 without further provision of heat by burners installed in the pre-heating zone 19.

The fumes, after having passed through the storage portion consisting of the first and second zones 18-19, leave the furnace 10 through an appropriate slit in the crown at the upstream end of the furnace 10 within a duct 31 for the fumes.

During a process with a cold charge the pre-heating zone 19 is heated by fumes coming from the heating and temperature equalization zone 20 of the furnace 10 and by burners arranged for this purpose in the pre-heating zone 19, whereas the temperature regeneration zone 18 is heated only by fumes coming from the pre-heating zone 19 and the heating and temperature equalization zone 20 of the furnace 10.

The hot material charged through the central intake 16 is positioned accurately both lengthwise and crosswise through a guide channel 22, the profile of which is obtained as follows:

the supporting bed, conformed in segments, consists of stationary longitudinal members 23;

the containing sidewalls, conformed in segments, consist of the front ends of movable longitudinal members 24, which belong respectively 24*a* to the storage portion 18-19 and 24*b* to the final heating portion 20.

The stationary longitudinal members 23 have a diminishing chute-type development 29 for vertical realignment of the hot product 26 being charged.

The hot material 17 is thrust into the furnace 10 by a known charging device 25, and its forward movement is halted when the leading end of the product 26 enters into cooperation with a halting mechanism consisting in this case of a final abutment element 27, which is advantageously adjusted from outside the furnace 10.

Introduction of the charge takes place with the movable longitudinal members 24 in a high position, so that they form a guide channel 22 the width of which is in proportion to the cross section of the product 26.

The movable longitudinal members 24*a* belong to the first furnace portion 10*a*, while the movable longitudinal members 24*b* belong to the second furnace portion 10*b*.

The movable longitudinal members 24 include an inclined frontal segment 28 so as to form horizontal guiding and conveying funnels to straighten the positioning of the product 26 being charged.

The charged product 26 is now engaged by the movable longitudinal members 24*b* and conveyed towards the discharge outlet or by the movable longitudinal members 24*a* and conveyed towards the storage portion of the furnace according to requirements.

As we said above, the guide channel 22 according to the invention is embodied with a series of funnels in a vertical direction and horizontal direction, which bring the leading end of the product 26 into the containing profile so as to assist introduction of the product 26 into the central guide channel 22.

The funnels consist of the inclined frontal segment 28 of the movable longitudinal members 24 and of the diminishing chute-type development 29 of the stationary longitudinal members 23, the diminishing chute 29 being arranged lengthwise in the stationary longitudinal members 23.

The sliding action taking place during charging assists the detachment of the already limited layer of oxidation on the outer surface of the product 26.

The heating furnace according to the invention comprises a system for discharge of this scale into collection hoppers 30 arranged in correspondence with the movable longitudinal members 24 and between two containing channels positioned below the movable longitudinal members 24.

We claim:

1. A furnace for heating and storing hot products, comprising:

a first furnace portion extending along a longitudinal axis having an inlet at an upstream end for introduction of a cold charge;

a second furnace portion extending along said longitudinal axis downstream of said first furnace portion and having an outlet at a downstream end for discharge of a heated charge;

a plurality of parallel spaced stationary longitudinal members extending along said longitudinal axis within said first and second furnace portions;

a first set of parallel spaced movable longitudinal members extending along said longitudinal axis and interposed between said plurality of parallel spaced stationary longitudinal members within said first furnace portion;

a second set of parallel spaced movable longitudinal members extending along said longitudinal axis and interposed between said plurality of parallel spaced stationary longitudinal members within said second furnace portion;

a central intake and guide channel extending substantially normal to said longitudinal axis and provided between said first and second furnace portions for introduction of charge from a continuous casting plant or from a previous hot process in a feed direction substantially normal to said longitudinal axis, a bed of said central intake and guide channel being defined by said plurality of parallel spaced stationary longitudinal members, and a width of said central intake and guide channel being defined by a space between facing downstream ends of said first set of parallel spaced movable longitudinal members and upstream ends of said second set of parallel spaced movable longitudinal members when said first and second sets of parallel spaced movable longitudinal members are in a raised position, said width of said central intake and guide channel being in proportion to a cross-section of said charge from said continuous casting plant or from said previous hot process, wherein sides of said downstream end of said first set of parallel spaced movable longitudinal members and sides of said upstream end of said second set of parallel spaced movable longitudinal members facing said feed direction comprise an initial bevelled segment thereby forming a funnel-like guide to position said charge.

2. A furnace as claimed in claim 1, wherein said furnace includes a crown having at least one lowered segment to separate the furnace into at least said first and second furnace portions.

3. A furnace as claimed in claim 1, further comprising a plurality of hoppers each of which is positioned between a pair of containing channels provided below one of said parallel spaced movable longitudinal members to collect scale detached from said charge during introduction through said central intake and guide channel.

4. A furnace as claimed in claim 1, wherein a height of said central intake and guide channel is defined by a height of said first and said second sets of parallel spaced movable longitudinal members in their raised position above said plurality of parallel spaced stationary longitudinal members.

5. A furnace as claimed in claim 1, wherein said first furnace portion is divided longitudinally into a heat regeneration zone at an upstream end thereof and a central pre-heating zone at a downstream end thereof.

6. A furnace as claimed in claim 5, wherein said furnace includes a crown having at least two lowered segments to separate said first furnace portion into said heat regeneration zone and said central pre-heating zone and to divide said first furnace portion from said second furnace portion.

7. A furnace as claimed in claim 6, wherein said second furnace portion and said central pre-heating zone each include burners therein, wherein said furnace comprises a duct in said crown at an upstream end of said heat regeneration zone wherein said central pre-heating zone can be heated by sensible heat contained in fumes coming from said second furnace portion or by a combination of said sensible heat contained in said fumes coming from said second furnace portion and by said burners provided in said central preheating zone, and wherein said heat regeneration zone is heated by sensible heat contained in fumes coming from said second furnace portion and said central pre-heating zone.

8. A furnace for heating and storing hot products, comprising:

a first furnace portion extending along a longitudinal axis having an inlet at an upstream end for introduction of a cold charge;

a second furnace portion extending along said longitudinal axis downstream of said first furnace portion and having an outlet at a downstream end for discharge of a heated charge;

a plurality of parallel spaced stationary longitudinal members extending along said longitudinal axis within said first and second furnace portions;

a first set of parallel spaced movable longitudinal members extending along said longitudinal axis and interposed between said plurality of parallel spaced stationary longitudinal members within said first furnace portion;

a second set of parallel spaced movable longitudinal members extending along said longitudinal axis and interposed between said plurality of parallel spaced stationary longitudinal members within said second furnace portion;

a central intake and guide channel extending substantially normal to said longitudinal axis and provided between said first and second furnace portions for introduction of charge from a continuous casting plant or from a previous hot process in a feed direction substantially normal to said longitudinal axis, a bed of said central intake and guide channel being defined by said plurality of parallel spaced stationary longitudinal members, and a width of said central intake and guide channel being defined by a space between facing downstream ends of said first set of parallel spaced movable longitudinal members and upstream ends of said second set of parallel spaced movable longitudinal members when said first and second sets of parallel spaced movable longitudinal members are in a raised position, said width of said central intake and guide channel being in proportion to a cross-section of said charge from said continuous casting plant or from said previous hot process, wherein sides of said parallel spaced stationary longitudinal members facing said feed direction within said central intake and guide channel comprise a diminishing chute-type development for vertically realigning said charge.

* * * * *